United States Patent [19]

Iyomasa

[11] 4,109,649

[45] Aug. 29, 1978

[54] FOOT MASSAGER

[76] Inventor: Arthur N. Iyomasa, 888 Mililani St., PH, Honolulu, Hi. 96813

[21] Appl. No.: 718,606

[22] Filed: Aug. 30, 1976

[51] Int. Cl.[2] ..... A61H 15/00

[52] U.S. Cl. ..... 128/57; 128/25 B

[58] Field of Search ..... 128/57, 25 B, 24.3

[56] References Cited

U.S. PATENT DOCUMENTS

| | | | |
|---|---|---|---|
| 3,037,500 | 6/1962 | Daugherty | 128/25 B |
| 3,411,498 | 11/1968 | Reiter | 128/57 |
| 3,662,748 | 5/1972 | Thurman | 128/25 B |
| 3,664,334 | 5/1972 | O'Neil | 128/57 |
| 3,970,078 | 7/1976 | Rogers | 128/57 |

*Primary Examiner*—Lawrence W. Trapp
*Attorney, Agent, or Firm*—James C. Wray

[57] ABSTRACT

A foot massager consists of a single plastic element shaped into a longitudinal inner cylinder having a plurality of rows of evenly spaced rounded projections arranged in staggered relationship annularly about the outer surface of the cylinder. Ends of the cylinder are formed into toroidal wheel-like supports. The massager is operated by pressing the bottom of the foot onto the projections and moving the foot at right angles to the cylinder, thereby allowing the device to roll on the floor on the wheel-like end supports.

8 Claims, 3 Drawing Figures

FIG. 1
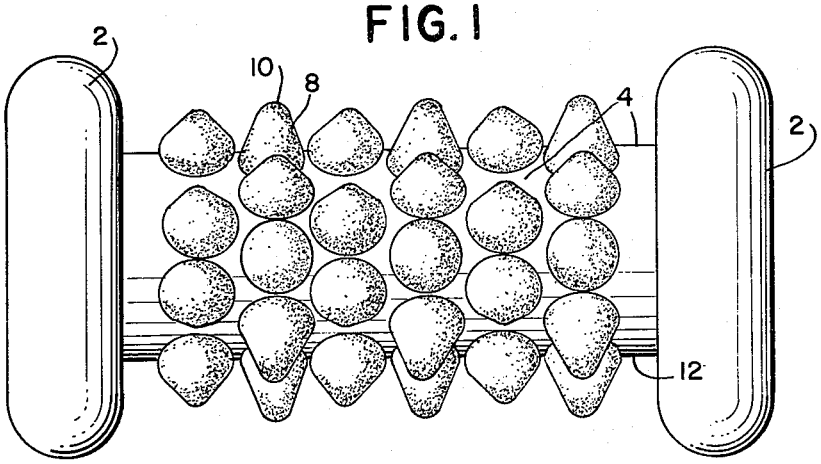
FIG. 2
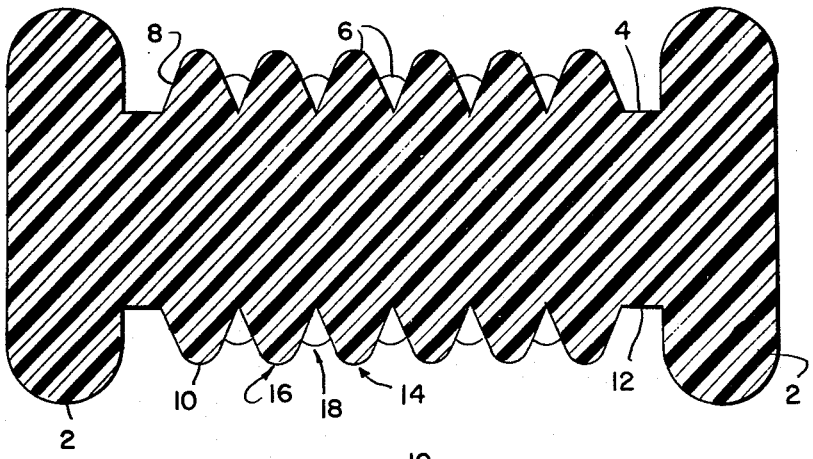
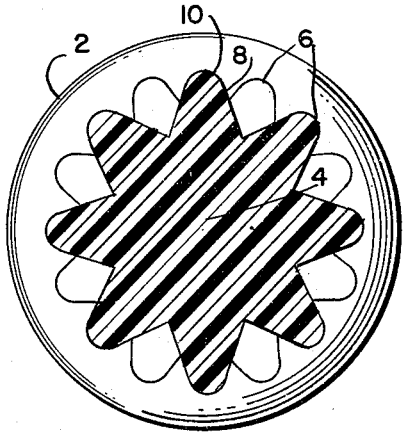
FIG. 3

FOOT MASSAGER

BACKGROUND OF THE INVENTION

Kinesthetic therapy devices are collected in Class 128, Surgery and Body Treatment, subclasses 56, 57, 60, 24.3 and 25B. The following U.S. Patents describe foot massagers: Nos.

1,481,038
3,548,814
1,962,971
3,662,748
2,448,797
3,888,241
3,037,500
2,663,293

U.S. Pat. No. 2,663,293 shows a cylinder having offset rows of bumps, however, when in use the bumps are covered. The device is mechanically operated.

U.S. Pat. No. 3,548,814 shows a nodulous cylinder having ends fixed to a platform allowing the cylinder to revolve around the fixed ends.

U.S. Pat. No. 3,888,241 uses an arrangement of dimples, skull cap recesses and ribs which are not offset.

A number of devices are rolled on the floor by the foot, but all have massaging elements on the inner cylinder which differ from the present invention.

U.S. Pat. No. 2,962,971 uses ridges instead of bumps. U.S. Pat. No. 2,448,797 has diagonal notches arranged on raised ribs. The bumps in U.S. Pat. No. 2,037,500 are not offset and continue a distance up the sides of wheel end supports. U.S. Pat. No. 3,662,748 uses offset notches in toroidal plates. U.S. Pat. No. 1,481,038 uses a tapered inner cylinder which does not have bumps across its entire outer surface.

The prior art lacks a portable, easily manufactured and inexpensive foot massager having closely spaced, interconnecting and alternating projections arranged annularly about a rigid member to repeatedly and alternately stretch and compress the skin, muscles and tendons of a foot bottom with sufficient force and rapidity over enough closely spaced foot bottom areas to achieve effective, convenient and efficient massaging of the foot.

SUMMARY OF THE INVENTION

In view of the deficiencies in the above disclosed prior art, a primary object of the invention disclosed herein is the provision of a portable, easily manufactured and inexpensive foot massager capable of achieving effective, convenient and efficient massaging of a foot.

Another object of this invention is the provision of a foot massager having closely spaced, interconnecting and alternating projections arranged annularly about a rigid member to repeatedly and alternately stretch and compress the skin, muscles and tendons of a foot bottom with sufficient force and rapidity over enough foot bottom area to achieve effective and efficient massaging of a foot.

Still another object of this invention is the provision of a foot massager having toroidal members freely rollable on a flat supporting surface and spaced a distance greater than transverse dimensions of a foot, an intermediate concentric cylindrical member of diameter less than the diameter of the toroidal members connecting the toroidal members, the outer surface of the cylindrical member having a plurality of closely interconnected and evenly spaced rows of projections annularly arranged in staggered relationship to engage the bottom of a foot under pressure and massage said foot when the toroidal members are rolled on the supporting surface.

A further object of this invention is the provision of a foot massager wherein the projections on the outer surface of the cylindrical member are cylindrical protrusions tapered in an outwardly radial direction from the cylindrical member, the taper ending in rounded dome tops on each protrusion.

A still further object of this invention is the provision of a foot massager comprising a unitary, rigid member.

These and other and further objects and features of the invention are apparent in the disclosure which includes the above and below specification and claims and drawings.

BRIEF DESCRIPTION OF THE DRAWINGS

FIG. 1 is a side elevational view of a foot massager embodying the principles of the present invention.

FIG. 2 is a side sectional view of another embodiment the foot massager illustrated in FIG. 1.

FIG. 3 is an end sectional view taken along the line 3—3 of the foot massager illustrated in FIG. 1.

DETAILED DESCRIPTION OF THE DRAWINGS

As shown in FIG. 1, a foot massager embodying the present invention consists of a pair of spaced toroidal end members 2 connected by an intermediate concentric cylindrical member 4 of diameter less than the diameter of the end members 2. This arrangement permits the end members 2 to serve as two parallel equal wheels capable of rolling across a flat supporting surface, such as a floor. The space between the end members 2 is greater than the transverse dimension of a foot, thereby permitting the bottom of a foot to easily rest on the cylindrical member 4 between the end members 2. The outer surface of the cylindrical member 4 has a plurality of closely and evenly spaced rows of projections 6 annularly arranged in staggered relationship. FIG. 3 best illustrates this staggered arrangement. These projections 6 engage the foot bottom placed on the cylindrical member 4. Spaces 12 between the end members and the projections on the cylindrical member prevent irritation of the side of the foot from projections rubbing against it while massaging the foot bottom.

As pressure from the foot resting on the cylindrical member 4 causes the end members 2 to roll along the supporting surface, the projections 6 with sloping conical walls 8 and spheroidal tips 10 on the outer surface of the cylindrical member 4 repeatedly and alternately stretch and compress the skin, muscles and tendons of the foot bottom with sufficient force and rapidity over enough foot bottom area to perform a satisfactory and useful foot massaging function. The spheroidal tips 10 deeply engage the underlying tissue and conical walls 8 uniformly outwardly pull the skin.

As best shown by FIGS. 2 and 3, the projections 6 on the cylindrical member 4 are tapered conical protrusions having sloping conical side walls 8 and rounded spheroidal tips 10.

The massager can be constructed from a unitary piece of any suitable rigid material such as, but not limited to, hard plastic.

In use, one stands on his left foot, for example, and places his right foot against projections 6 between toroids 2 and moves his right foot forward and backward.

Spaced similar rows 14 and 16 of projections have offset rows 18 therebetween so that the side by side projections in rows 14 and 16 support spaced areas of the foot bottom and so the tips 10 of projections 6 of row 18 subsequently engage closely adjacent intermediate areas to stretch the skin and underlying tissue downward along the conical walls 8 of the projections while suspending the adjacent alternating surface areas between adjacent spheroidal tips 10. Alternatively, one stands on his left foot and places his right foot against the device and at a forty-five degree angle to the floor. Pushing forward on the right foot causes the device to roll along the floor and skid along the foot bottom, rapidly pounding the foot bottom skin with the closely spaced projections.

While the invention has been described with reference to a specific embodiment the exact nature and scope of the invention is defined in the following claims.

What we claim is:

1. A foot massaging apparatus comprising toroidal members freely rollable on a flat supporting surface and spaced a distance greater than transverse dimensions of a foot, an intermediate concentric cylindrical member of diameter less than the diameter of the toroidal members connecting the toroidal members, the outer surface of the cylindrical member having a plurality of parallel annular rows of closely spaced projections arranged in staggered meshing relationship to engage the bottom of a foot under pressure and massage said foot when the toroidal members are rolled on the supporting surface.

2. The foot massaging apparatus of claim 1 wherein the projections on the outer surface of the cylindrical member comprise rigid conical protrusions tapered from wide to narrow from the cylindrical member and terminated outwardly in rounded spheroidal tips.

3. The foot massaging apparatus of claim 2 wherein the apparatus comprises a unitary rigid member.

4. The foot massaging apparatus of claim 2 wherein the rows of conical protrusions are spaced substantially inwardly from the toroidal members.

5. The foot massaging apparatus of claim 4 wherein the rows of conical protrusions are spaced inwardly from the toroidal members a distance equal to one-half the diameter of the portion of the protrusion adjacent the cylindrical member.

6. The foot massaging apparatus of claim 2 wherein the centers of the conical protrusions in adjacent rows are offset by from each other a distance equal to about one-half the diameter of the portion of the protrusion adjacent the cylindrical member.

7. The foot massaging apparatus of claim 1 wherein the rows are spaced substantially inwardly from the toroidal members.

8. The foot massaging apparatus of claim 7 wherein the rows are spaced inwardly from the toroidal members a distance equal to one-half the maximum transverse dimensions of the projections.

* * * * *